US007407012B2

(12) United States Patent
Keshavan et al.

(10) Patent No.: US 7,407,012 B2
(45) Date of Patent: Aug. 5, 2008

(54) THERMALLY STABLE DIAMOND CUTTING ELEMENTS IN ROLLER CONE DRILL BITS

(75) Inventors: Madapusi K. Keshavan, The Woodlands, TX (US); Anthony Griffo, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 51 days.

(21) Appl. No.: 11/189,425

(22) Filed: Jul. 26, 2005

(65) Prior Publication Data

US 2007/0023206 A1 Feb. 1, 2007

(51) Int. Cl.
*E21B 10/00* (2006.01)

(52) U.S. Cl. ..... 166/374; 425/426; 425/434; 425/435

(58) Field of Classification Search ..... 175/374, 175/425, 426, 434, 435
See application file for complete search history.

(56) References Cited

U.S. PATENT DOCUMENTS

| | | | | |
|---|---|---|---|---|
| 4,104,344 A | | 8/1978 | Pope et al. | |
| 4,288,248 A | | 9/1981 | Bovenkerk et al. | |
| 4,899,922 A | * | 2/1990 | Slutz et al. | 228/121 |
| 5,173,090 A | | 12/1992 | Scott et al. | |
| 5,248,006 A | | 9/1993 | Scott et al. | |
| 5,346,026 A | | 9/1994 | Pessier et al. | |
| 5,706,906 A | * | 1/1998 | Jurewicz et al. | 175/428 |

(Continued)

FOREIGN PATENT DOCUMENTS

EP 1212511 B1 10/2003

(Continued)

OTHER PUBLICATIONS

Combined Search and Examination Report issued in Application No. GB0614556.9 on Nov. 22, 2006 (7 pages).

(Continued)

*Primary Examiner*—Giovanna C Wright
(74) *Attorney, Agent, or Firm*—Osha Liang LLP

(57) ABSTRACT

A roller cone drill bit for drilling earth formations includes a bit body having at least one roller cone rotably attached to the bit body and a plurality of cutting elements disposed on the at least one roller cone in a plurality of rows arranged circumferentially around the at least one roller cone, wherein at least one cutting element in the gage row, the heel row, or a surface of the at least one roller cone bounded by the gage and heel rows comprises thermally stable polycrystalline diamond or a thermally stable polycrystalline diamond composite. The at least one cutting element may be a TSD insert or a TSD composite insert and may be formed by brazing, sintering, or bonding by other technologies known in the art a thermally stable polycrystalline diamond table to a substrate. The interface between the diamond table and the substrate may be non-planar. A roller cone drill bit includes a bit body, at least one roller cone rotably attached to the bit body, and a plurality of cutting elements disposed on the at least one roller cone, where at least one of the plurality of cutting elements comprises thermally stable polycrystalline diamond or a thermally stable polycrystalline diamond composite and a cutting surface, wherein at least a portion of the cutting surface is contoured.

23 Claims, 7 Drawing Sheets

U.S. PATENT DOCUMENTS

| | | | | |
|---|---|---|---|---|
| 5,855,247 | A * | 1/1999 | Scott et al. | 175/374 |
| 5,944,129 | A | 8/1999 | Jensen | |
| 6,196,340 | B1 | 3/2001 | Jensen et al. | |
| 6,408,959 | B2 * | 6/2002 | Bertagnolli et al. | 175/432 |
| 6,527,069 | B1 | 3/2003 | Meiners et al. | |
| 6,651,757 | B2 | 11/2003 | Belnap et al. | |
| 2004/0159471 | A1 | 8/2004 | Azar et al. | |
| 2005/0263328 | A1 * | 12/2005 | Middlemiss | 175/434 |

FOREIGN PATENT DOCUMENTS

| | | |
|---|---|---|
| GB | 2408735 | 6/2005 |
| WO | 97/35091 | 9/1997 |

OTHER PUBLICATIONS

Canadian Office Action issued in Application No. CA 2552934 on Nov. 29, 2007 (2 pages).

* cited by examiner

THERMALLY STABLE DIAMOND CUTTING ELEMENTS IN ROLLER CONE DRILL BITS

BACKGROUND OF INVENTION

1. Field of the Invention

The invention relates generally to roller cone drill bits for drilling earth formations. More specifically, the invention relates to thermally stable diamond inserts in roller cone drill bits.

2. Background Art

Roller cone drill bits are commonly used in oil and gas drilling applications. FIG. 1 shows a conventional drilling apparatus for drilling a wellbore. The drilling system 1 includes a drill rig 2 that rotates a drill string 3 that extends downward into a wellbore 5 and is connected to a roller cone drill bit 4.

FIG. 2 shows a typical roller cone drill bit in more detail. The roller cone drill bit includes a top end 13 threaded for attachment to a drill string and a bit body 10 having legs 14 depending therefrom, to which roller cones 30 are attached. The roller cones 30 are able to rotate with respect to the bit body 10. Cutting elements 17, 18, 19 are disposed on the roller cones 30 and are typically arranged in rows 15, 16 arranged circumferentially around the roller cones 30.

The types of loads and stresses encountered by a particular row of cutting elements depends in part on its relative axial location on the roller cone. For instance, still referring to FIG. 2, inner rows of cutting elements 15 that are located more radially proximal an axis of rotation of the roller cone than outer rows 16, 20 tend to gouge and scrape an earth formation due to their relatively low rotational velocities about the roller cone and bit axes. Thus, cutting elements 17 in the inner rows 15 on the roller cone are typically either milled teeth or inserts that are made from a softer and tougher grade of tungsten carbide that is capable of withstanding the shear stresses created from the gouging and scraping cutting action. In contrast, outer rows of cutting elements, which typically include a gage row 16 and a heel row 20 disposed at a position more proximal the leg 14, to which the roller cone 30 is attached, than the inner rows 15, tend to cut a formation through a crushing and grinding action. This cutting action subjects the gage and heel rows 16, 20 to substantial compressive loads and severe abrasive and impact wear when drilling through a hard earth formation. For these reasons, the cutting elements 18, 19 in the gage and heel rows 16, 20 are typically inserts that comprise harder grades of a tungsten carbide composite material or a superhard material such as polycrystalline diamond compact. Primary functions of the gage row cutting elements 18 include cutting the bottom of the wellbore and cutting and maintaining the wellbore diameter. Often a drill bit will become under gage due to abrasive wear of the gage row cutting elements 18. Heel row cutting elements 19 serve to compensate for this loss in bit diameter and maintain the diameter of the wellbore.

Still referring to FIG. 2, the cutting elements 17, 18, 19 may be milled teeth that are formed integrally with the material from which the roller cones 30 are made or inserts that are bonded to the roller cones 30 through brazing, sintering, or other bonding technologies known in the art, or attached to the roller cones 30 by interference fit through insertion into apertures (not shown) in the roller cones 30. The inserts may be tungsten carbide inserts, diamond enhanced tungsten carbide inserts, or superhard inserts such as polycrystalline diamond compacts.

Tungsten carbide inserts typically comprise tungsten carbide that has been sintered with a metallic binder to create a tungsten carbide composite material also known as cemented tungsten carbide. The metallic binder chosen is usually cobalt because of its high affinity for tungsten carbide. Due to the presence of the metallic binder, the tungsten carbide composite has a greater capability to withstand tensile and shear stresses than does pure tungsten carbide, while retaining the hardness and compressive strength of tungsten carbide.

Referring to FIG. 3*a*, a polycrystalline diamond compact (PDC) insert 300 comprises a substrate 301—that is generally cylindrical in shape—to which a polycrystalline diamond table 302 is bonded at an interface 303. The interface 303 between the diamond table and the substrate may take on various geometries, such as planar or non-planar, depending on the particular drilling application. Diamond crystals are sintered with a substrate, typically a tungsten carbide composite, and a metallic binder, typically cobalt, to form a PDC insert. The metallic binder acts as a catalyst for the formation of bonds between the diamond crystals and the substrate 301. The metallic binder also promotes bonding between individual diamond crystals (known as diamond-diamond boundaries in the art) resulting in the formation of a layer of randomly oriented diamond crystals organized in a lattice structure with the metallic binder located in the interstitial spaces between the diamond crystals. This layer 302, known as a diamond table, may also be bonded to the substrate material 301 through a brazing process, or other bonding technologies known in the art, to form the PDC cutting insert 300. The diamond table 302 is the part of the insert intended to contact an earth formation and can be formed into various geometries, including dome-shaped, beveled, or flat, depending on the given drilling application. The random orientation of the diamond crystals in the diamond table 302 impedes fracture propagation and improves impact resistance.

Although PDC inserts are typically used in connection with fixed cutter bits, they have increasingly become an alternative to tungsten carbide inserts for use in roller cone drill bits due to their increased compressive strength and increased wear resistance, as well as their increased resistance to fracture propagation resulting from shear or tensile stresses during drilling.

PDC inserts are typically subject to three types of wear: abrasive and erosive wear, impact wear, and wear resulting from thermal damage. Absent any thermal effects, volumetric wear of a PDC insert from abrasion is proportional to the compressive load acting on the insert and the rotational velocity of the insert. Abrasive wear occurs when the edges of individual diamond grains are gradually removed through impact with an earth formation. Abrasive wear can also result in cleavage fracturing along the entire plane of a diamond grain. Depending on the thickness of the polycrystalline diamond table of the PDC insert, as diamond is eroded away through contact with the formation, new diamond is exposed to the formation.

PDC inserts are also subject to thermal damage due to heat produced at the contact point between the insert and the formation. The heat produced is proportional to the compressive load on the insert and its rotational velocity. PDC inserts are generally thermally stable up to a temperature of 750° Celcius (1382° Fahrenheit), although internal stress within the polycrystalline diamond table begins to develop at temperatures exceeding 350° Celcius (662° Fahrenheit). This internal stress is created by differences in the rates of thermal expansion at the interface between the diamond table and the substrate to which it is bonded. This differential in thermal expansion rates produces large compressive and tensile stresses on the PDC insert and can initiate stress risers that cause delamination of the diamond table from the substrate.

At temperatures of 750° Celcius (1382° Fahrenheit) and above, stresses on the PDC insert increase significantly due to differences in the coefficients of thermal expansion of the diamond table and the cobalt binder. The cobalt thermally expands significantly faster than the diamond causing cracks to form and propagate in the lattice structure of the diamond table, eventually leading to deterioration of the diamond table and ineffectiveness of the PDC insert.

For the reasons stated above, weight on bit (WOB) and rotary speed are carefully controlled for drill bits employing PDC cutting inserts, so as to maintain the insert contact point temperature below the threshold temperature of 350° Celcius (662° Fahrenheit). For this purpose, a critical penetrating force (vertical force component of WOB) above which the threshold temperature will be exceeded is determined, and the WOB and rotary speed are adjusted so as to not exceed the critical penetrating force. Maintaining the WOB and rotary speed of a drill bit such that the critical penetrating force is not exceeded prolongs the life of the PDC insert, but at the same time reduces the rate of penetration (ROP) of the drill bit. The heat generated from the PDC insert's contact with an earth formation can differ depending on the type of formation being drilled, and if a particular formation tends to generate very high temperatures, the viable ROP of bits with PDC inserts may be below the desired ROP and the drill bit's effectiveness severely limited.

In order to reduce the problems associated with differential rates of thermal expansion in PDC inserts, thermally stable polycrystalline diamond (TSD) inserts may be used for drill bits that experience high temperatures in the wellbore. A cross-sectional view of a typical TSD cutting insert is shown in FIG. 3*b*. The TSD includes a thermally stable polycrystalline diamond table 308 bonded to a substrate 306 at an interface 307. The substrate 306 may comprise a tungsten carbide composite, a diamond impregnated composite, or cubic boron nitride.

TSD may be created by "leaching" residual cobalt or other metallic catalyst from a polycrystalline diamond table. Examples of "leaching" processes may be found, for example, in U.S. Pat. Nos. 4,288,248 and 4,104,344. In a typical "leaching" process a heated strong acid (e.g. nitric acid, hydrofluoric acid, hydrochloric acid, or perchloric acid) or combinations of various heated strong acids are applied to a polycrystalline diamond table to remove at least a portion of the cobalt or other metallic catalyst from the diamond table. All of the cobalt may be removed through leaching, or only a portion may be removed. TSD formed through the removal of all or most of the cobalt catalyst is thermally stable up to a temperature of 1200° Celcius (2192° Fahrenheit), but is more brittle and vulnerable to shear and tensile stresses than PDC. Thus, it may be desirable to "leach" only a portion of the cobalt from the polycrystalline diamond table to provide thermal stability at higher temperatures than PDC while still maintaining adequate toughness and resistance to shear and tensile stresses.

TSD inserts may be used on the inner rows of a roller cone. The use of TSD inserts in the gage and heel rows of a roller cone, however, is not known in the art. Also, TSD inserts having a contoured cutting surface are not known in the art.

SUMMARY OF INVENTION

In one embodiment, the present invention relates to a roller cone drill bit comprising a bit body, at least one roller cone rotably attached to the bit body, and a plurality of cutting elements disposed on the at least one roller cone in a plurality of rows arranged circumferentially around the at least one roller cone, the plurality of rows comprising a gage row and a heel row, wherein at least one cutting element in the gage row, the heel row, or a surface of the at least one roller cone bounded by the gage and heel rows comprises thermally stable polycrystalline diamond.

In another embodiment, the present invention relates to roller cone drill bit comprising a bit body, at least one roller cone rotably attached to the bit body, and a plurality of inserts disposed on the at least one roller cone, wherein at least one of the plurality of inserts comprises thermally stable polycrystalline diamond and a cutting surface, wherein at least a portion of the cutting surface is contoured.

In another embodiment, the present invention relates to a roller cone drill bit comprising a bit body, at least one roller cone rotably attached to the bit body, and a plurality of cutting elements disposed on the at least one roller cone in a plurality of rows arranged circumferentially around the at least one roller cone, the plurality of rows comprising a gage row and a heel row, wherein at least one cutting element in the gage row, the heel row, or a surface of the at least one roller cone bounded by the gage and heel rows comprises a thermally stable polycrystalline diamond composite.

In another embodiment, the present invention relates to roller cone drill bit comprising a bit body, at least one roller cone rotably attached to the bit body, and a plurality of inserts disposed on the at least one roller cone, wherein at least one of the plurality of inserts comprises a thermally stable polycrystalline diamond composite and a cutting surface, wherein at least a portion of the cutting surface is contoured.

Other aspects and advantages of the present invention will be apparent from the following description and the appended claims.

BRIEF DESCRIPTION OF DRAWINGS

FIG. 5*b* is a perspective view of a TSD cutting insert having a flat top portion in accordance with an embodiment of the invention.

FIG. 5*c* is a perspective view of a TSD cutting insert having a curved top portion in accordance with an embodiment of the invention.

FIG. 5*d* is a perspective view of a TSD cutting insert having a beveled top portion in accordance with an embodiment of the present invention.

DETAILED DESCRIPTION

Figure 1:
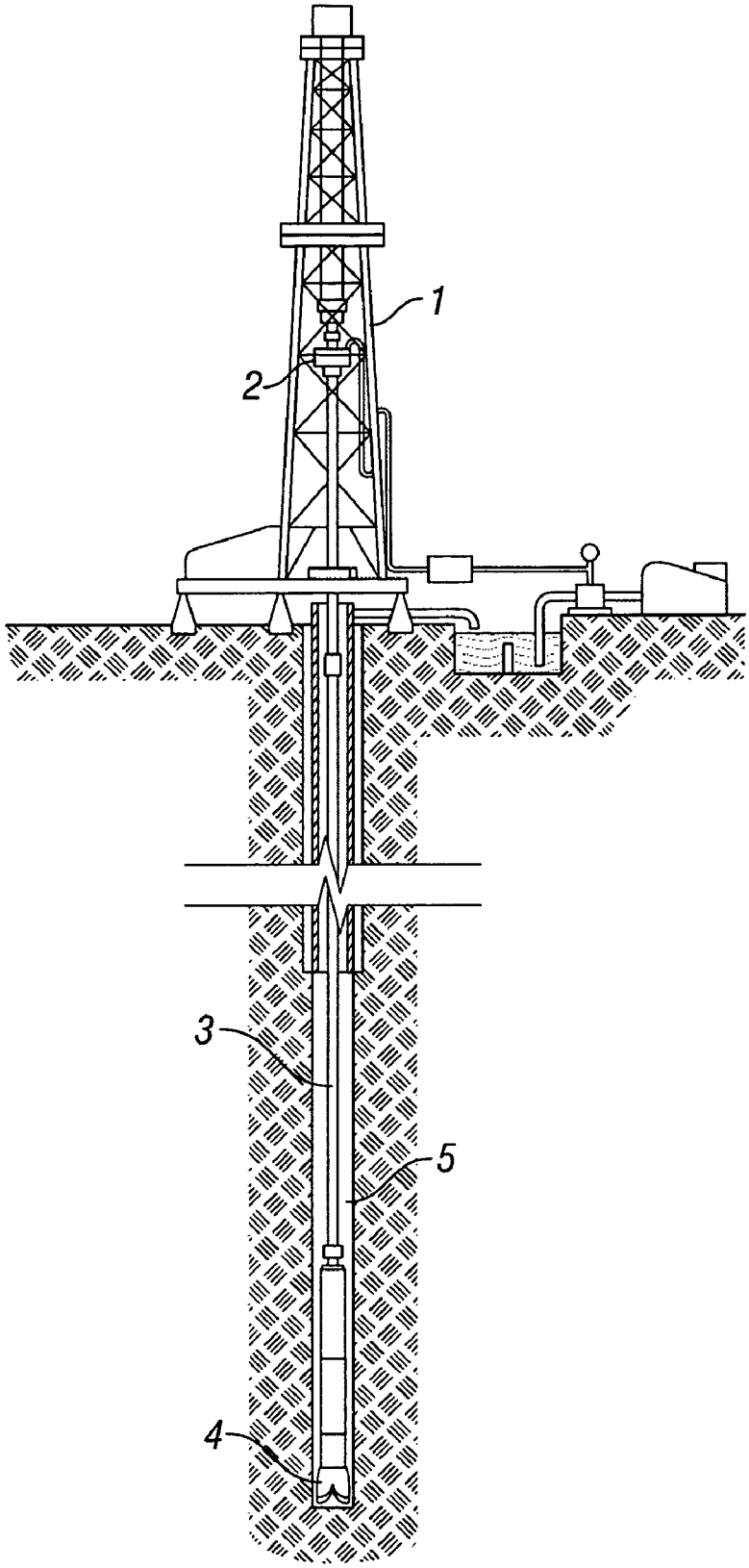
FIG. 1 is a perspective view of a conventional drilling apparatus.
Figure 2:
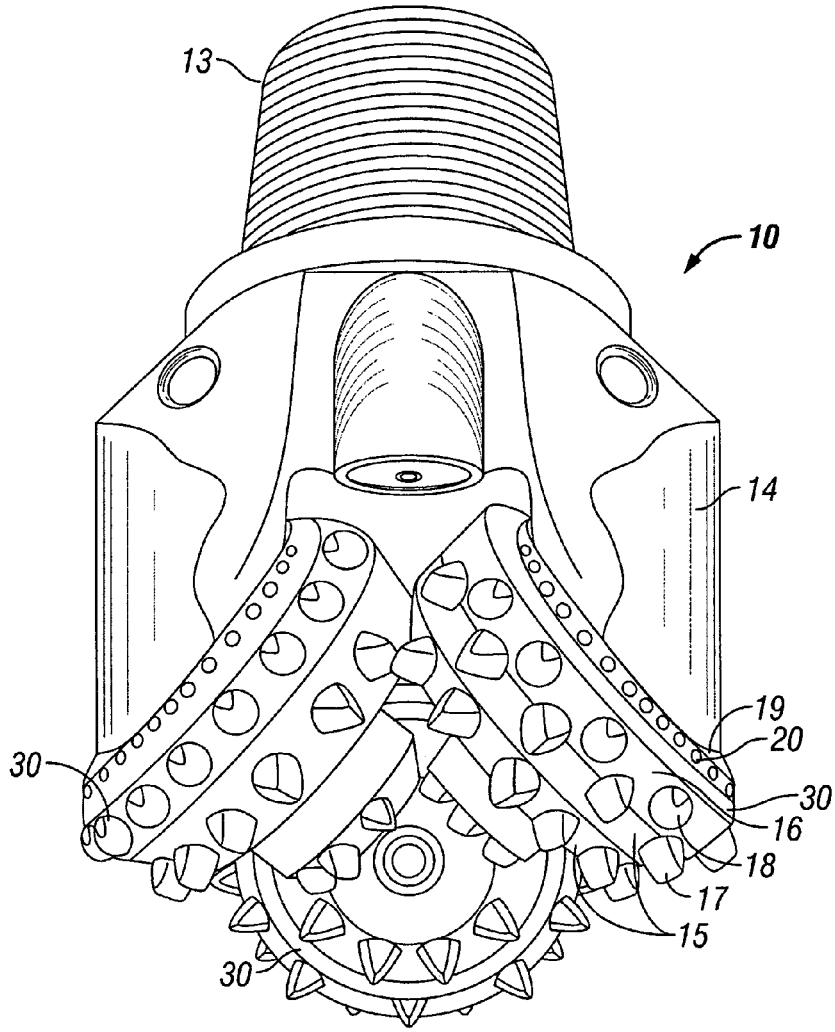
FIG. 2 (Prior Art)
FIG. 2 is a perspective view of a prior art roller cone drill bit.
Figure 3A:
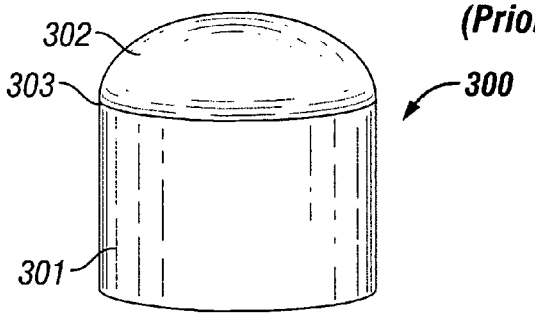
FIG. 3A (Prior Art)
FIG. 3*a* is a cross-sectional view of a prior art PDC cutting insert.
Figure 3B:
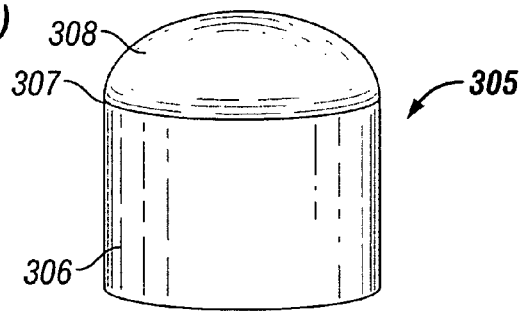
FIG. 3B (Prior Art)
FIG. 3*b* is a cross-sectional view of a prior art TSD cutting insert.

During the course of drilling, the life of a drill bit is often limited by the failure rate of the cutting elements mounted on the bit. Cutting elements may fail at different rates depending on a variety of factors. Such factors include, for example, the geometry of a cutting element, the location of a cutting element on a bit, a cutting element's material properties, and so forth.

The relative radial position of a cutting element along a roller cone's rotational axis is an important factor affecting the extent of wear that the cutting element will experience during drilling, and consequently, the life of the cutting element. Cutting elements disposed on the outer rows of a roller cone, in particular the gage and heel rows, experience more abrasive and impact wear than cutting elements disposed on the inner rows of a roller cone. Gage row cutting elements serve the dual functions of cutting the bottom of a wellbore and cutting and maintaining the wellbore diameter or the "gage." Because gage row cutting elements contact an earth formation more often and at a higher rotational velocity than other cutting elements, they are particularly prone to wear due to abrasive, impact, shear, and tensile forces. Gage row cutting elements also commonly experience temperatures in excess of 350° Celcius (662° Fahrenheit) due to the frictional heat created through abrasive contact with the earth formation.

Heel row cutting elements also serve to maintain a wellbore's diameter. Drills bits often become prematurely under gage due to abrasive wear of the gage row cutting elements. When this occurs, heel row cutting elements maintain the original bit diameter and ensure a wellbore diameter of the desired size. Similar to gage row cutting elements, heel row cutting elements are also subject to high temperatures due to high rotational speeds and compressive loads.

As a result of the substantial abrasive and impact forces acting on the gage and heel row cutting elements of a roller cone, tungsten carbide inserts or PDC inserts are often used for these rows. PDC inserts may be used for the gage or heel rows of a roller cone due to the extreme hardness of polycrystalline diamond and its resistance to impact and abrasive wear. As mentioned above, however, gage and heel row cutting elements are often subject to high temperatures, often exceeding 350° Celcius (662° Fahrenheit). At these temperatures, PDC begins to microscopically degrade due to internal stresses created within the diamond table by differential thermal expansion of the diamond and the cobalt binder. At temperatures of 750° Celcius (1290° Fahrenheit) and above, PDC becomes highly thermally unstable and the differential thermal expansion noted above leads to macroscopic cleavage of the diamond-diamond boundaries within the diamond table.

Embodiments of the present invention relate to the use of TSD inserts in the gage and heel rows of a roller cone drill bit. Additionally, embodiments of the present invention relate to the use of TSD inserts on the surface of a roller cone bounded by the gage and heel rows. TSD is thermally stable up to 1200° Celcius (2192° Fahrenheit), and consequently, is not as prone to the structural degradation that occurs in PDC inserts at high temperatures. Therefore, the use of TSD inserts in the gage and heel rows of a roller cone will ensure the structural integrity of the gage and heel row cutting elements at the high temperatures often experienced by these cutting elements, and thus, prolong their life. As a result, ROP may improve and drilling costs may decrease because it is not necessary to replace the gage and heel row cutting elements as often.

Figure 4:
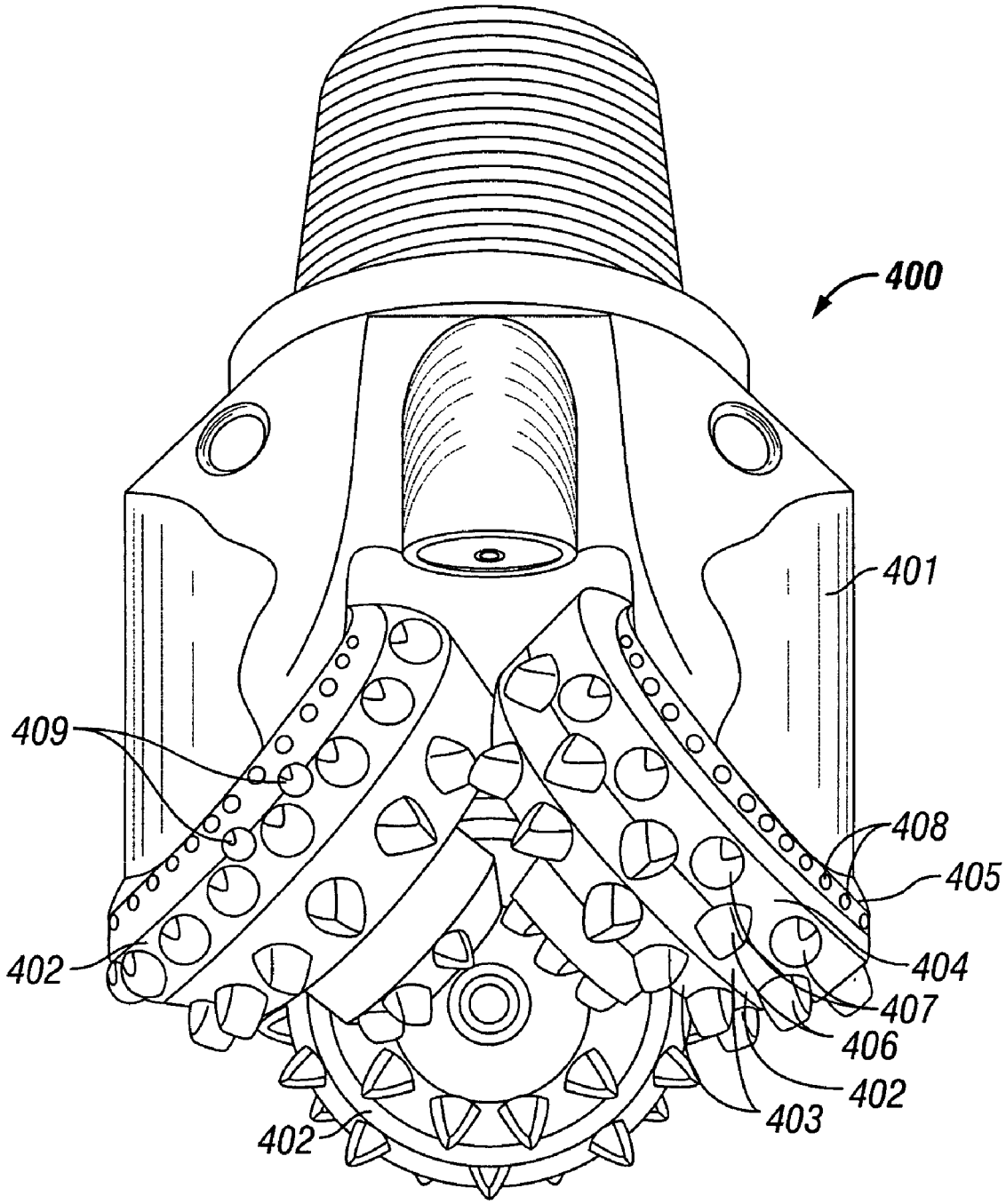
FIG. 4 is a perspective view of a roller cone drill bit in accordance with an embodiment of the invention.

Referring to FIG. 4, in one embodiment, the invention relates to a roller cone drill bit 400 comprising a bit body 401 with roller cones 402 rotably attached to the bit body 401. Any number of roller cones 402, including only a single cone, may be attached to the bit body 401, although three is the most common number of cones used. Cutting elements 406, 407, 408 are disposed in rows 403, 404, 405 arranged circumferentially around the roller cones 402. The rows of cutting elements comprise inner rows 403 and outer rows including a gage row 404 and a heel row 405. The cutting elements 406 forming the inner rows 403 may be milled teeth or inserts comprising tungsten carbide, a tungsten carbide composite, PDC, or TSD. One or more of the cutting elements 407 forming the gage row 404 may be an insert that comprises thermally stable polycrystalline diamond. Additionally, the one or more of the cutting elements 407 forming the gage row 404 that comprises thermally stable polycrystalline diamond may further comprise a contoured cutting surface. The contoured cutting surface may take on various geometries such as dome-shaped, chiseled, asymmetric, beveled, curved, etc. These various contour geometries will be discussed in further detail herein. Similarly, one or more of the cutting elements 408 forming the heel row 405 may be an insert that comprises thermally stable polycrystalline diamond. The one or more of the cutting elements 408 forming the heel row 405 that comprises thermally stable polycrystalline diamond may further comprise a contoured cutting surface having any of the geometries discussed above.

Additionally, cutting elements 409 may be disposed on a surface of the roller cones 402 bounded by the gage row 404 and the heel row 405. One or more of the cutting elements 409 may comprise thermally stable polycrystalline diamond. The particular position of the cutting elements 409 in FIG. 4 shall not be deemed to be limiting, as the cutting elements 409 may be located anywhere on the surface of the roller cones 402 bounded by the gage row 404 and the heel row 405. The one or more of the cutting elements 409 that comprises thermally stable diamond may further comprise a contoured cutting surface having any of the geometries discussed above. The cutting elements 406, 407, 408, 409 may be bonded to the roller cones 402 using any method known in the art, such as a high pressure high temperature (HPHT) sintering process or a brazing process. Alternatively, the cutting elements 406, 407, 408, 409 may be mechanically attached to the bit body 402 by interference fit.

Figure 5A:
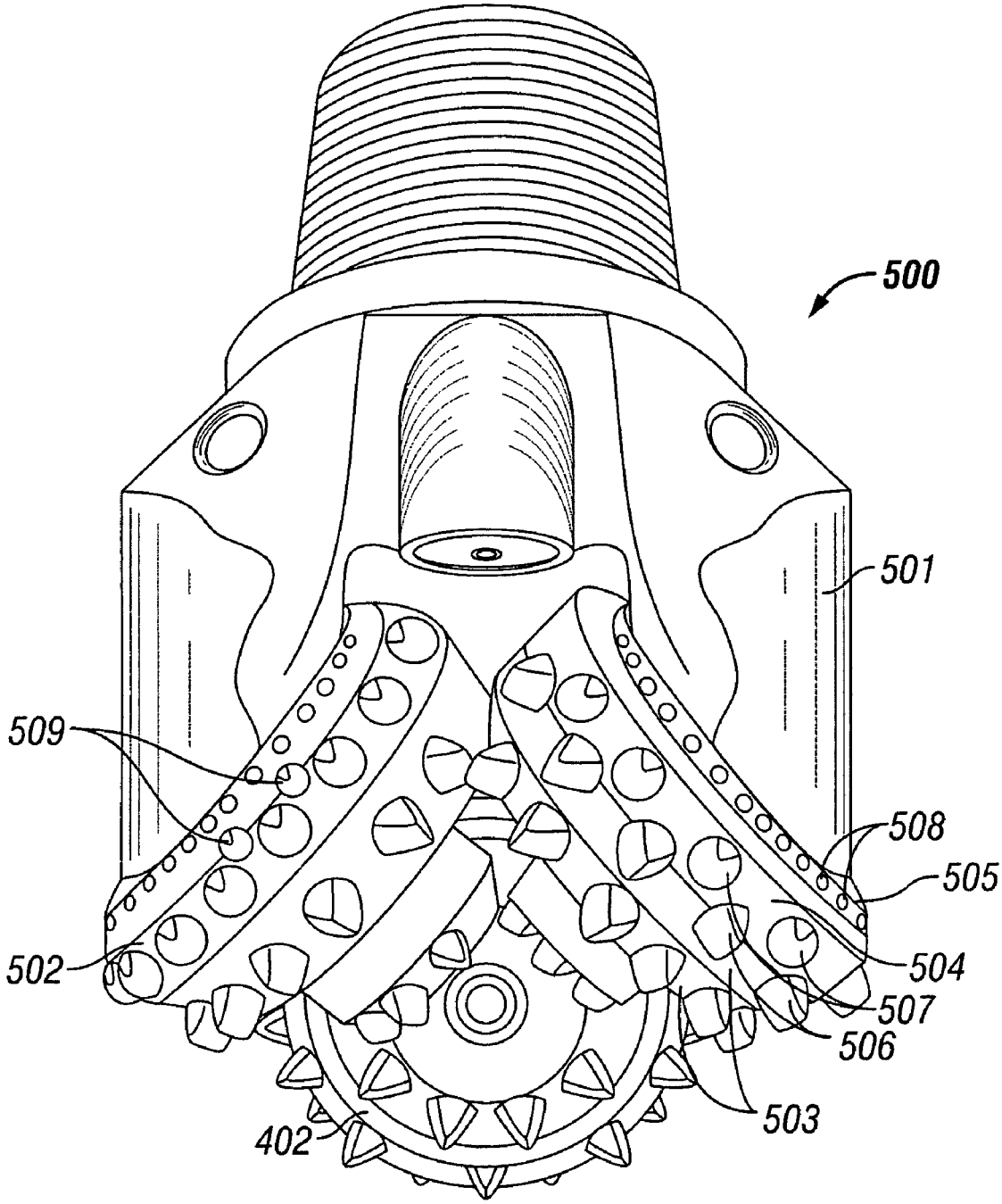
FIG. 5*a* is a perspective view of a roller cone drill bit in accordance with an embodiment of the invention.

Referring to FIG. 5*a*, in another embodiment, the invention relates to a roller cone drill bit 500 comprising a bit body 501 with roller cones 502 rotably attached to the bit body 501. Any number of roller cones 502, including only a single cone, may be attached to the bit body, although three is the most common number of cones used. Cutting elements 506, 507, 508 are disposed in rows 503, 504, 505 arranged circumferentially around the roller cones 502. The rows of cutting elements comprise inner rows 503 and outer rows including a gage row 504 and a heel row 505. The cutting elements 506 forming the inner rows 503 may be milled teeth or inserts comprising tungsten carbide, a tungsten carbide composite, PDC, TSD, or a TSD composite. One or more of the cutting elements 506 may comprise thermally stable polycrystalline diamond and a contoured cutting face or a thermally stable polycrystalline diamond composite and a contoured cutting face. The contoured cutting face may take on various geometries such as dome-shaped, chiseled, asymmetric, beveled, curved, etc. These various geometries will be discussed in further detail herein. One or more of the cutting elements 507 forming the gage row 504 may comprise a thermally stable polycrystalline diamond composite insert. This TSD insert 507 may comprise a contoured cutting face having any of the geometries discussed above in referenced to cutting elements 506. Similarly, one or more of the cutting elements 508 forming the heel row 505 may comprise a thermally stable polycrystalline diamond composite insert, which may further comprise a contoured cutting face having any of the geometries discussed above.

As used herein, thermally stable polycrystalline diamond composite shall mean any combination of thermally stable polycrystalline diamond and any number of other materials. The thermally stable polycrystalline diamond composite insert may, for example, comprise thermally stable polycrystalline diamond combined with silicon or thermally stable polycrystalline diamond combined with silicon carbide.

Additionally, cutting elements 509 may be disposed on a surface of the roller cones 502 bounded by the gage row 504 and the heel row 505. The cutting elements 509 may comprise a thermally stable polycrystalline diamond composite. The particular position of the cutting elements 509 in FIG. 5 shall not be deemed to be limiting, as the cutting elements 509 may be disposed anywhere on the surface of the roller cones 502 bounded by the gage row 504 and the heel row 505. The cutting elements 506, 507, 508, 509 may be bonded to the roller cones 502 using any method known in the art, such as a high pressure high temperature (HPHT) sintering process or a brazing process. Alternatively, the cutting elements 506, 507, 508, 509 may be mechanically attached to the bit body 502 by interference fit.

Figure 5B:
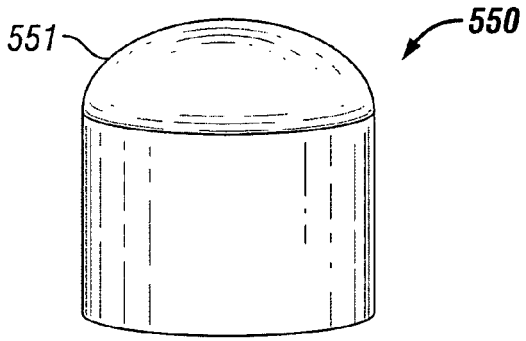
FIGS. 5*b*-5*f* are perspective views of contoured cutting elements in accordance with embodiments of the invention.
Figure 5C:
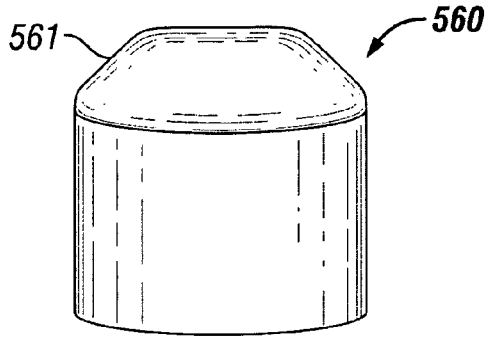
Figure 5D:
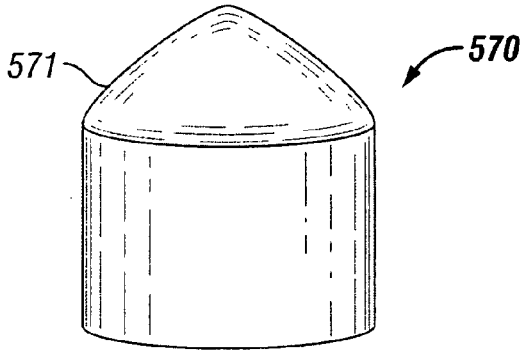
Figure 5E:
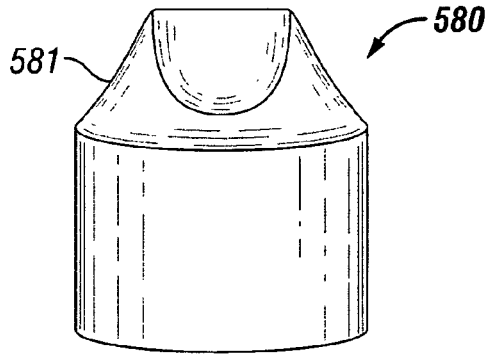
Figure 5F:
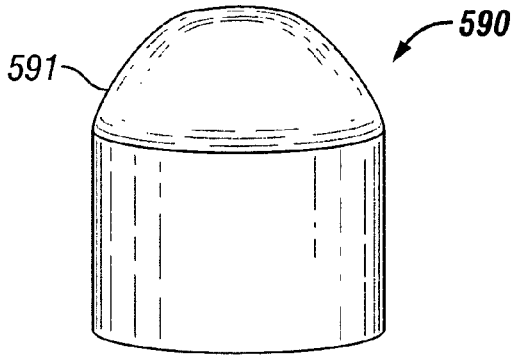

FIGS. 5*b*-5*f* show various embodiments of cutting elements in accordance with the invention. The cutting elements depicted by FIGS. 5*b*-5*f* are inserts that comprise thermally stable polycrystalline diamond or a thermally stable polycrystalline diamond composite. Further, these inserts comprise contoured cutting surfaces. Referring to FIG. 5*b*, an insert 550 comprises a dome-shaped cutting surface 551. This particular insert geometry is useful when drilling highly abrasive rock formations. Referring to FIG. 5*c*, an insert 560 comprises a beveled cutting surface 561. Referring to FIG. 5*d*, an insert 570 comprises an asymmetric cutting surface 571. Referring to FIG. 5*e*, an insert 580 comprises a chiseled cutting surface 581. The beveled cutting surface 561, the asymmetric cutting surface 571, and the chiseled cutting surface 581 may be desired when drilling through formations of medium hardness that are more effectively drilled through shearing and scraping action of the cutting elements. Referring to FIG. 5*f*, an insert 590 comprises a curved, semi-conical cutting surface 591. A cutting element, in accordance with the invention, comprising TSD or a TSD composite and a contoured cutting surface shall not be limited to the particular geometries depicted in FIGS. 5*b*-5*f*, but may have any contoured cutting surface known in the art.

Figure 6:
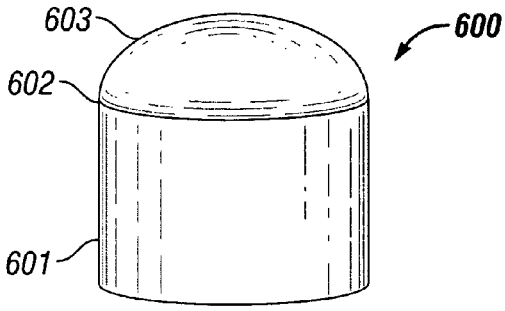
FIG. 6 is a cross-sectional view of a TSD cutting insert in accordance with an embodiment of the invention.

Referring to FIG. 6, a TSD insert 600 made in accordance with an embodiment of the invention comprises a substrate 601 bonded to a thermally stable polycrystalline diamond table 603 at an interface 602. As used herein, the term thermally stable polycrystalline diamond table shall mean a diamond table that comprises thermally stable polycrystalline diamond or a thermally stable polycrystalline diamond composite. The substrate 601 is generally cylindrical in shape and may comprise tungsten carbide, a tungsten carbide composite such as a tungsten metal-carbide, a diamond impregnated material, or other materials known in the art. The thermally stable polycrystalline diamond table 603 may comprise thermally stable polycrystalline diamond or a thermally stable polycrystalline diamond composite. The thermally stable polycrystalline diamond composite may be a composite of thermally stable polycrystalline diamond and silicon, silicon carbide, or other desirable materials.

As described above, the TSD insert 600 may be formed through sintering diamond crystals and the substrate 601 with a metallic binder, typically cobalt. The cobalt acts as a catalyst in the formation of diamond-diamond bonds between individual diamond crystals, creating a polycrystalline layer known as a diamond table, and promotes bonding between the diamond table and the substrate 601. To create the thermally stable polycrystalline diamond table 603, residual cobalt may be leached from the polycrystalline diamond table. All of the cobalt may be leached from the polycrystalline diamond table, or only a portion of the cobalt may be leached if greater resistance to fracture propagation is desired. As used herein, leaching only a portion of a diamond table shall mean removing only a portion of the metallic binder from the diamond table in any dimension. For example, if the polycrystalline diamond table has a depth of 1.0 mm, the cobalt may be leached from the diamond table to a depth of 0.5 mm. Similarly, if the diamond table has a width of 1 cm, the cobalt may be leached to 0.5 cm—only a portion of the total width of the diamond table. The substrate 601 and the thermally stable polycrystalline diamond table 603 may be bonded at the interface 602 through sintering at high temperature and high pressure (HPHT) with a metallic binder. The interface 602 may be planar or non-planar and can take on various geometries which will be described in further detail.

Other bonding technologies may also be used to form the TSD insert in FIG. 6. For example, various pressure assisted sintering processes such as hot pressing, spark plasma sintering, hot isostatic pressing, ROC™, CERACON™, dynamic compaction, explosion compaction, powder extrusion, and alternative sintering processes such as diffusion bonding, microwave sintering, plasma assisted sintering, and laser sintering may be employed. The foregoing listing of bonding processes is merely illustrative and shall not be deemed to be limiting, as any bonding process known in the art may be used to bond the thermally stable polycrystalline diamond table 603 to the substrate 601.

Hot pressing may be used to bond the diamond table 603 to the substrate 601. Hot pressing involves the application of high pressure and temperature to a die which houses the material or materials to be pressed within a cavity. The substrate material, which may be tungsten carbide, cubic boron nitride, or other metal-carbides or nitrides, is placed in a die, typically in powder form, along with diamond crystals and a metallic binder, typically cobalt, and then subjected to high pressure and temperature. As a result, the metallic binder stimulates bonding between the individual diamond crystals and between the crystals and the substrate material to form an insert. The insert may then be removed from the die cavity and residual cobalt may be leached from the diamond table to form the TSD insert depicted in FIG. 6.

Alternatively, hot isostatic pressing may be used to form a TSD insert. Hot isostatic pressing (HIP) involves the use of high pressure gas that is isostatically applied to a pressure vessel encapsulating the material or materials to be pressed at an elevated temperature. HIP can be used to consolidate encapsulated metal powder or to bond dissimilar materials through diffusion bonding. In either case, HIP results in the removal of porosity from the material or materials to which HIP is applied. When bonding two dissimilar materials, such as a diamond table and a metal-carbide substrate, HIP causes microscopic atomic transport across the bonding surface, resulting in the removal of pores along the bonding line and bonding the diamond table to the metal-carbide substrate. The other bonding processes listed above, as well as any other bonding processes known in the art, may also be used to bond the diamond table 603 to the substrate 601.

Figure 7:
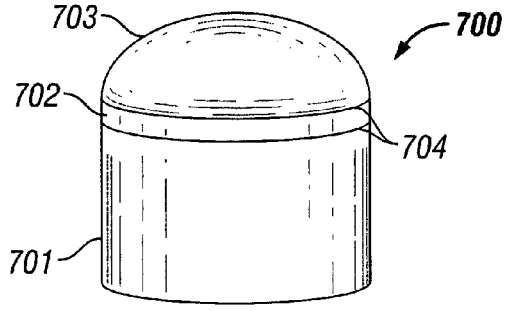
FIG. 7 is a cross-sectional view of a TSD cutting insert in accordance with an embodiment of the invention.

Referring to FIG. 7, in another embodiment, a TSD insert 700 is formed through brazing a thermally stable polycrystalline diamond table 703 to a substrate 701 using a brazing filler material 702. Brazing involves depositing the brazing filler material 702 between the thermally stable polycrystalline diamond table 703 and the substrate 701 and heating to a temperature that exceeds the melting point of the brazing filler material 702 but not the melting points of the diamond table 703 or the substrate 701. At its liquidis temperature, the molten brazing filler material 702 interacts with thermally stable polycrystalline diamond table 703 and the substrate 701, and upon cooling forms a strong metallurgical bond between the two. The brazing filler material 702 may be pure nickel, a nickel-copper alloy, a silver alloy, or any other brazing filler material known in the art. In some instances, the brazing filler material 702 may not alone provide the desired strength of the bond between the diamond table 703 and the substrate 701. A mechanical locking mechanism may be used to strengthen the brazed bond between the diamond table 703 and the substrate 701. One such mechanical locking mechanism is a locking-cap interface, described in greater detail herein. Any locking mechanism known in art may also be used. The thermally stable polycrystalline diamond table 703 may be formed by any of the methods described earlier and may comprise thermally stable polycrystalline diamond or a thermally stable polycrystalline diamond composite. The thermally stable polycrystalline diamond composite may be a combination of thermally stable polycrystalline diamond and silicon, silicon carbide, or any other desired materials. The substrate 701 may comprise of any of the materials described above in reference to FIG. 6. The interface 704 between the thermally stable polycrystalline diamond table 703 and the substrate 701 may have a planar or non-planar geometry depending on the particular drilling application for which the TSD insert 700 will be used.

Figure 8A:
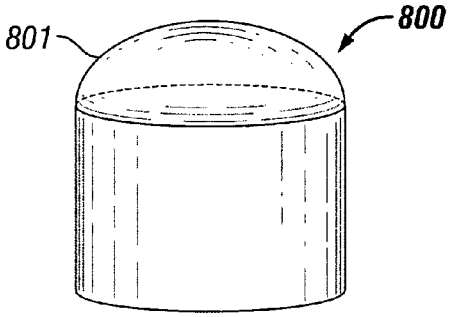
FIG. 8*a* is a perspective view of a TSD cutting insert having a dome-shaped top portion in accordance with an embodiment of the invention.
Figure 8B:
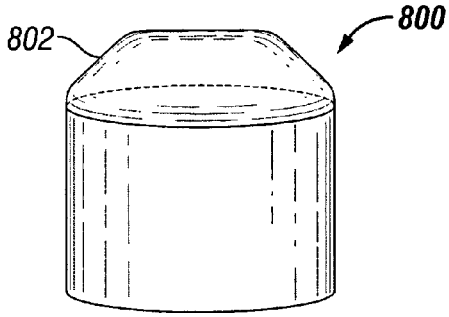
Figure 8C:
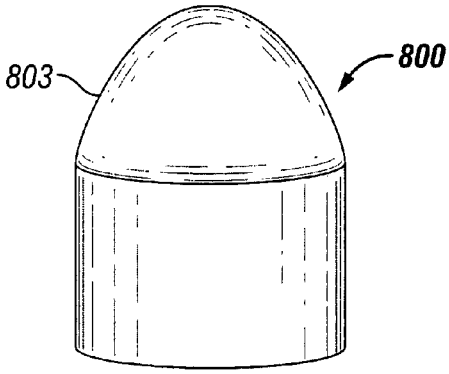
Figure 8D:
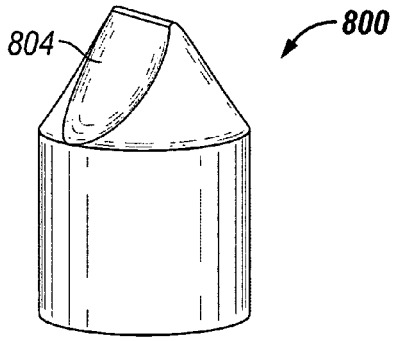

FIGS. 8*a*-8*d* show TSD inserts made in accordance with various embodiments of the invention. As shown in FIG. 8*a*, in one embodiment, a top portion 801 of the TSD insert 800 may be dome-shaped. As used herein, a "top portion" refers to the surface of an insert that is intended to contact and cut an earth formation. Dome-shaped inserts are often used for highly abrasive earth formations to minimize abrasive wear on the insert. Referring to FIG. 8*b*, in another embodiment of the invention, a top portion 802 of the TSD insert 800 may be flat. Other insert geometries in accordance with embodiments of the invention are shown in FIGS. 8*c* and 8*d*. Referring to FIG. 5*c*, a top portion 803 of the TSD insert 800 may be curved. Referring to FIG. 8*d*, a top portion 804 of the TSD insert 800 may be beveled. Wire electron discharge machines (EDM) may be used to cut and shape diamond tables to form these various insert geometries.

Figure 9A:
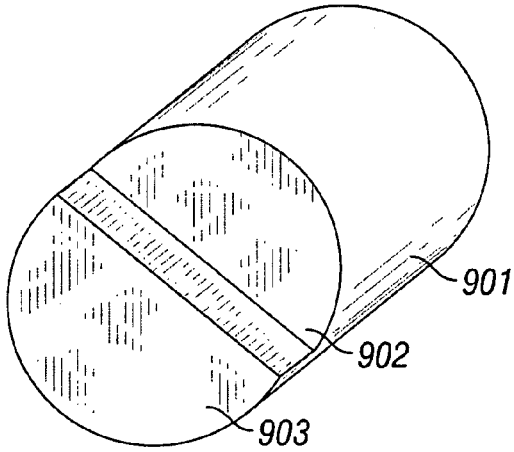
FIG. 9*a* is a perspective view of a planar interface between a substrate and a diamond table of a TSD cutting insert in accordance with an embodiment of the invention.

TSD inserts in accordance with embodiments of the invention may have a planar or non-planar interface between the substrate and the thermally stable polycrystalline diamond table. Referring to FIG. 9*a*, a TSD insert 900 in accordance with an embodiment of the invention comprises an interface 902 between a substrate 901 and a thermally stable polycrystalline diamond table 903 which is planar.

Figure 9B:
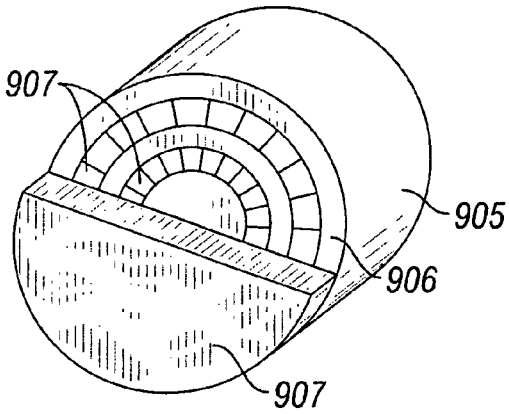
FIG. 9*b* is a perspective view of a non-planar ringed interface between a substrate and a diamond table of a TSD cutting insert in accordance with an embodiment of the invention.

For certain drilling applications, increased bond strength and area between the substrate 901 and the thermally stable polycrystalline diamond table 903 is desired. To serve these purposes, a variety of non-planar interface shapes may be used. Referring to FIG. 9*b*, in one embodiment of the invention, a substrate 905 is bonded to a thermally stable polycrystalline diamond table 907 at a non-planar ringed interface 906. The interface 906 comprises multiple circular rings 907 of varying amplitude. The increased bond strength and area provided by the interface 906 reduces residual stresses acting on the insert and improves resistance to chipping, spalling, and delimination of the diamond table 907 from the substrate 905.

Figure 9C:
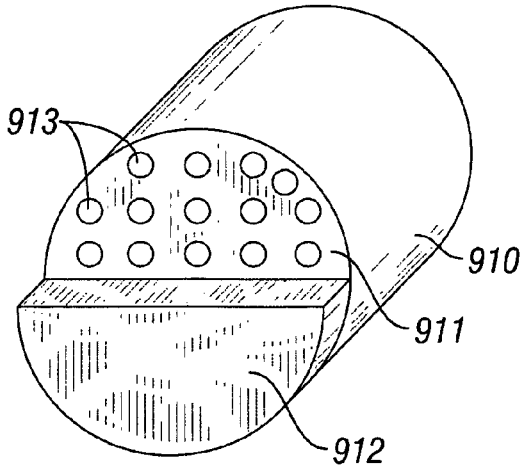
FIG. 9*c* is a perspective view of a non-planar locking cap interface between a substrate and a diamond table of a TSD cutting insert in accordance with an embodiment of the invention.

In another embodiment, as shown in FIG. 9*c*, a substrate 910 is bonded to a thermally stable polycrystalline diamond table 912 at a non-planar locking cap interface 911. The locking caps 913 maximizes impact resistance and minimizes residual stresses acting on the insert 920.

Advantages of the invention may include one or more of the following. Gage and heel row cutting elements are subjected to severe abrasive and impact wear during drilling, as well as, high temperatures at which polycrystalline diamond compact is not stable. Use of TSD inserts in the gage and heel rows of a roller cone will maintain thermal stability of the inserts at temperatures at which PDC undergoes degradation, thus prolonging the life of the gage and heel row cutting elements.

Use of TSD inserts for the gage and heel rows of a roller cone may improve ROP as compressive loads acting on the drill bit and its rotational velocity can be increased absent the "critical penetrating force" constraint imposed by PDC inserts.

Use of TSD inserts for the gage and heel rows of a roller cone may decrease drilling costs because TSD inserts will not need replacement as often as TCI or PDC inserts.

Use of TSD inserts which comprise a contoured cutting surface allow for more efficient drilling of formations for which a particular contour is suited.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body;

at least one roller cone rotably attached to the bit body; and a plurality of cutting elements disposed on the at least one roller cone in a plurality of rows arranged circumferentially around the at least one roller cone, the plurality of rows comprising:

at least one inner row;

a gage row; and a heel row; wherein at least one cutting element in the gage row, the heel row, or a surface of the at least one roller cone bounded by the gage and heel rows is a thermally stable polycrystalline diamond cutting element comprising:

a carbide substrate; and a thermally stable polycrystalline diamond top portion disposed on the carbide substrate; wherein carbide substrate has a greater volume than the thermally stable polycrystalline diamond top portion; and at least one cutting element in the at least one inner row comprises at least one of a milled tooth and a tungsten carbide insert, consisting of cemented tungsten carbide.

2. The drill bit of claim 1, wherein the thermally stable polycrystalline diamond cutting element further comprises a cutting surface, wherein at least a portion of the cutting surface is contoured.

3. The drill bit of claim 2, wherein the contour is at least one selected from dome-shaped, chiseled, asymmetric, beveled and curved.

4. The drill bit of claim 1, wherein the thermally stable polycrystalline diamond top portion is bonded to the substrate by sintering with a metallic binder.

5. The drill bit of claim 4, wherein the metallic binder is at least one selected from cobalt and nickel.

6. The drill bit of claim 1, wherein the thermally stable polycrystalline diamond top portion is bonded to the substrate by at least one method selected from hot pressing, spark plasma sintering, hot isostatic pressing, quasi-isostatic pressing, rapid omnidirectional compaction, dynamic compaction, explosion compaction, powder extrusion, diffusion bonding, microwave sintering, plasma assisted sintering, and laser sintering.

7. The drill bit of claim 1, wherein the thermally stable polycrystalline diamond top portion is bonded to the substrate by brazing with a brazing filler material.

8. The drill bit of claim 7, wherein the brazing filler material is at least one selected from nickel, a nickel-copper alloy, and a silver alloy.

9. The drill bit of claim 7, wherein the brazing is conducted in a vacuum.

10. The drill bit of claim 1, wherein the substrate is at least one selected from tungsten carbide, a tungsten carbide composite material, and a diamond impregnated material.

11. The drill bit of claim 1, wherein the bond between the substrate and the thermally stable polycrystalline diamond top portion forms a non-planar interface.

12. The drill bit of claim 1, wherein the bond between the thermally stable polycrystalline diamond top portion and the substrate is reinforced by a mechanical locking mechanism.

13. A drill bit comprising:

a bit body;

at least one roller cone rotably attached to the bit body;

a plurality of cutting elements disposed on the at least one roller cone in a plurality of rows arranged circumferentially around the at least one roller cone, the plurality of rows comprising, at lease one inner row;

a gage row; and a heel row; wherein at least one cutting element in the gage row, the heel row, or a surface of the at least one roller cone bounded by the gage and heel rows comprises:

a substrate; and a thermally stable polycrystalline diamond top portion formed from diamond and at least one of silicon and silicon carbide, wherein the thermally stable polycrystalline diamond top portion is disposed on the substrate; and at least one cutting element in the at least one inner row comprises at least one of a milled tooth and a tungsten carbide insert, consisting of cemented tungsten carbide.

14. The drill bit of claim 13, wherein the at least one cutting element comprises a cutting surface, wherein at least a portion of the cutting surface is contoured.

15. The drill bit of claim 13, wherein the thermally stable diamond top portion is bonded to the substrate by sintering with a metallic binder.

16. The drill bit of claim 15, wherein the metallic binder is at least one selected from cobalt and nickel.

17. The drill bit of claim 13, wherein the thermally stable polycrystalline diamond top portion is bonded to the substrate by at least one method selected from hot pressing, spark plasma sintering, hot isostatic pressing, quasi-isostatic pressing, rapid omnidirectional compaction, dynamic compaction, explosion compaction, powder extrusion, diffusion bonding, microwave sintering, plasma assisted sintering, and laser sintering.

18. The drill bit of claim 13, wherein the thermally stable polycrystalline diamond top portion is bonded to the substrate by brazing using a brazing filler material.

19. The drill bit of claim 18, wherein the brazing filler material is at least one selected from nickel, a silver alloy, and a nickel-copper alloy.

20. The drill bit of claim 18, wherein the brazing is conducted in a vacuum.

21. The drill bit of claim 13, wherein the substrate is at least one selected from tungsten carbide, a tungsten carbide composite material, and a diamond impregnated material.

22. The drill bit of claim 13, wherein the bond between the thermally stable polycrystalline diamond top portion and the substrate forms a non-planar interface.

23. The drill bit of claim 13, wherein the bond between the thermally stable polycrystalline diamond top portion and the substrate is reinforced by a mechanical locking mechanism.

* * * * *